United States Patent [19]

Collins

[11] 4,258,825

[45] Mar. 31, 1981

[54] POWERED MANLIFT CART

[76] Inventor: Pat L. Collins, 6619 Wo. Windermere St., Littleton, Colo. 80120

[21] Appl. No.: 906,960

[22] Filed: May 18, 1978

[51] Int. Cl.[3] ..... E04G 1/22; E04G 1/24

[52] U.S. Cl. ..... 182/14; 182/63; 182/148; 180/79.1; 180/321

[58] Field of Search ..... 182/13, 14, 63, 148, 182/141, 2; 180/241, 251, 231, 255, 79.1, 43 R

[56] References Cited

U.S. PATENT DOCUMENTS

| | | | |
|---|---|---|---|
| 2,632,530 | 3/1953 | Wagner | 187/9 |
| 2,787,278 | 4/1957 | Mitchell | 182/2 |
| 2,989,140 | 6/1961 | Hill et al. | 182/63 |
| 2,995,380 | 8/1961 | King | 182/2 |
| 3,095,945 | 7/1963 | Mitchell | 182/14 |
| 3,468,398 | 9/1969 | Galloway | 182/141 |
| 3,509,965 | 5/1970 | Mitchell | 182/63 |
| 3,817,346 | 6/1974 | Wehmeyer | 182/14 |
| 3,961,681 | 6/1976 | Fisher | 180/66 |

*Primary Examiner*—Reinaldo P. Machado

*Attorney, Agent, or Firm*—Ancel W. Lewis, Jr.

[57] ABSTRACT

A compact powered manlift cart suitable for usage in building interiors for raising and supporting an operator at elevated heights. The cart has front and rear wheels of which one front and one rear wheel are driven by a two-speed drive motor through a chain and sprocket drive train. Power driven front and rear steering assemblies allow the front and rear wheels to be steered independently of one another making the cart highly maneuverable. A lift mast for raising and supporting the operator includes a lift bucket wherein the operator stands during operation of the cart and also includes telescoping mast sections driven by a motor through a cable and pulley arrangement. The mast is extended and retracted for positioning the lift bucket at various heights up to a maximum height for supporting the operator for overhead work. A hand operated control box with a single control rod allows the operator to selectively control the speed and movement of the cart and movement of the mast while standing in the lift bucket or while separated from the cart.

28 Claims, 23 Drawing Figures

Fig.-4
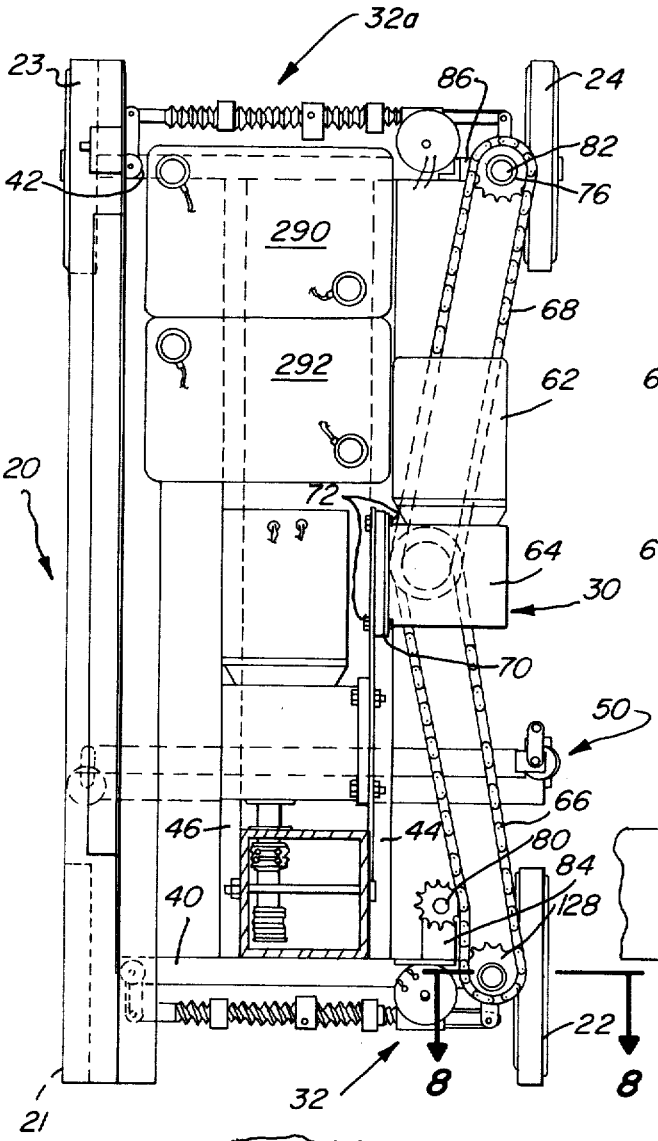
Fig.-7
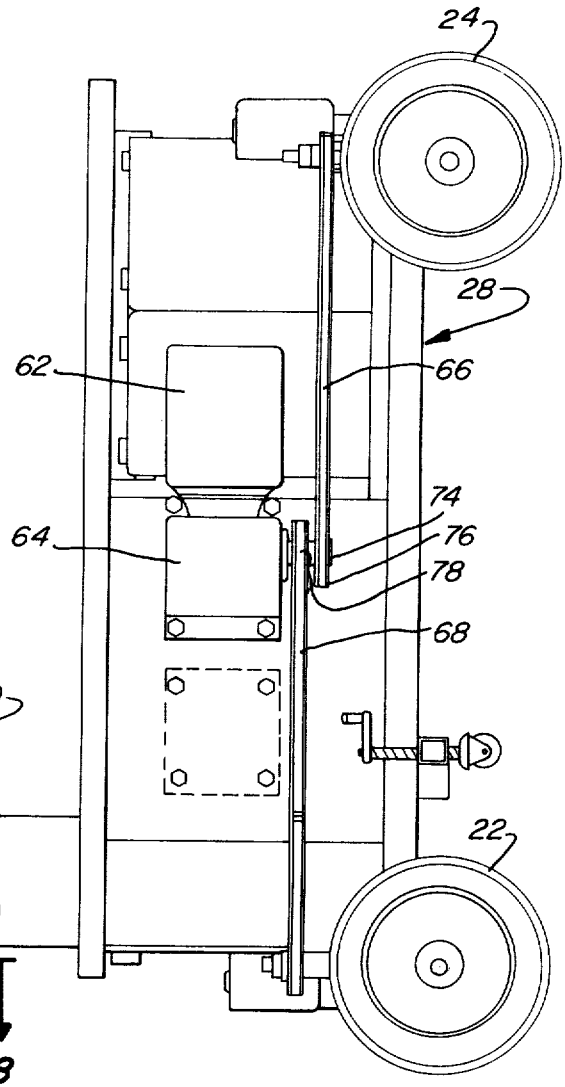
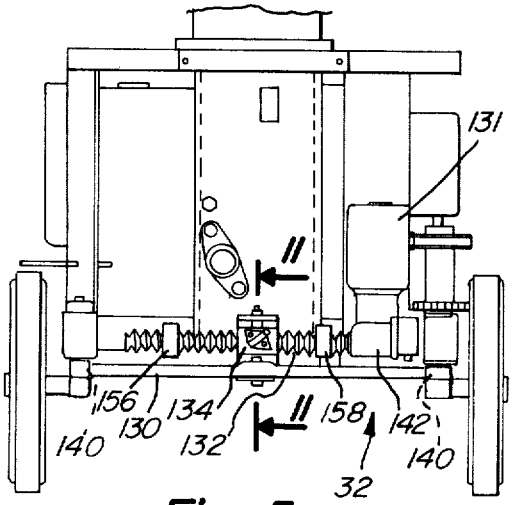
Fig.-5
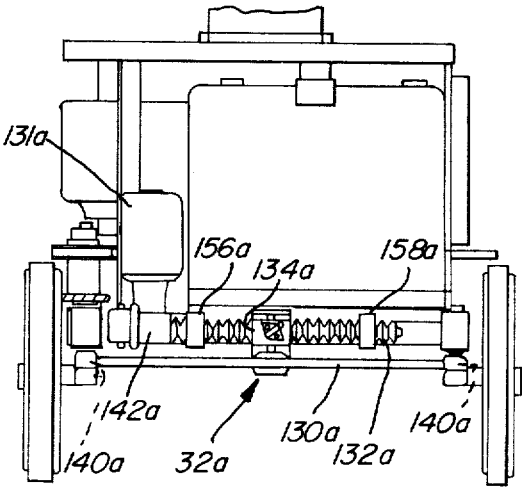
Fig.-6

POWERED MANLIFT CART

FIELD OF THE INVENTION

This invention generally relates to overhead service equipment and more particularly to novel and improved powered manlift apparatus characterized by compact dimensions and high mobility.

BACKGROUND OF THE INVENTION

In the past the ladder or scaffolds have provided the usual means for enabling a worker to operate at elevated positions. Some of the deficiencies of these devices have been the inconvenience and slowness of their transport to the point of use, as well as a general loss of time, lack of maneuverability and overall lack of working ease for the worker in the elevated position. Some attempts have been made to provide powered manlifts for lifting and supporting an operator in an elevated position. Most of the prior art units are relatively large rigs geared towards outdoor usage such as in construction, fruit harvesting, and mining. U.S. Pat. Nos. 2,249,900, 2,632,530, 2,989,140, 3,384,201, and 3,817,346 are representative of these types of manlifts. Other prior art manlifts such as the manlifts disclosed in U.S. Pat. Nos. 3,016,973, 3,095,945, and 3,509,965 are smaller and more mobile than the previously mentioned manlifts and are suitable for indoor industrial usage such as in maintaining elevated building fixtures, utilities, and machinery.

One area where mobile manlifts are not generally utilized is in service or construction activities carried out in commercial establishments such as in restaurants, hotels, stores, and the like where limited space and carpeted floors prevent the operation of a large or heavy manlift. In the installation of draperies and drapery rods in commercial establishments for instance, simple platforms or ladders are generally used instead of mobile manlifts for supporting workmen in elevated positions because the prior art manlifts are generally too heavy and not maneuverable enough to be effectively utilized in the building interiors.

Accordingly, it is an object of the present invention to provide a highly compact and highly maneuverable powered manlift cart suitable for use in general construction, remodeling and maintenance.

Another object of the present invention is to provide a mobile powered manlift cart characterized by a two speed drive for vehicle movement and a power-driven steering arrangement for maneuvering the cart.

Yet another object of the present invention is to provide a compact manlift cart having a novel mast arrangement for raising and lowering an operator to different heights.

Still another object of the present invention is to provide a powered manlift cart that can be maneuvered by an operator while situated either on or off the cart.

Another object of the present invention is to provide a self-propelled cart having dimensions and wheel maneuverability to pass through conventional doorways on which there is mounted an extensible mast arranged with a platform and a single control rod operated by the worker on the platform to selectively move the cart, turn the wheels and raise the mast to locate the worker at a selected elevated location.

Other objects, advantages and capabilities of the present invention will become more apparent as the description proceeds taken in conjunction with the accompanying drawings, in which:

FIG. 4 is a plan view of the cart with the body and other parts removed;

FIG. 5 is a front elevation view of the manlift cart shown with the body removed;

FIG. 6 is a rear elevation view of the manlift cart shown with the body removed;

FIG. 7 is a side elevation view of the manlift cart shown with the body removed;

SUMMARY OF THE INVENTION

A manlift cart powered entirely by one power source which preferably is in the form of electric storage batteries carried thereon and having a lift mast for raising and lowering an operator to various heights. The cart has four wheels of which a front and a rear wheel are driven by a variable speed drive motor through chain drives and chain sprockets meshing with gear plates on the wheels. The drive motor is operable at one of two speeds for driving the cart at a high or low speed. Power operated steering mechanisms on the front and rear sets of wheels allow the front and rear wheels to be steered and positioned independently of one another making the cart highly maneuverable. The lift mast includes a support bucket wherein the operator may stand and movable telescoping mast sections for raising and lowering the support bucket comprised of four sections of rectangular tubing slidably telescoped in one another and supported for vertical telescoping movement relative to one another. The mast sections can be extended and retracted for raising and lowering the lift bucket and operator by a pulley and cable arrangement driven by a mast motor. A hand operated control box with a single control rod allows the operator to control the speed and movement of the cart and the movement of the mast while standing in the support bucket or while standing away from the cart.

DESCRIPTION OF THE PREFERRED EMBODIMENT

Figure 1:
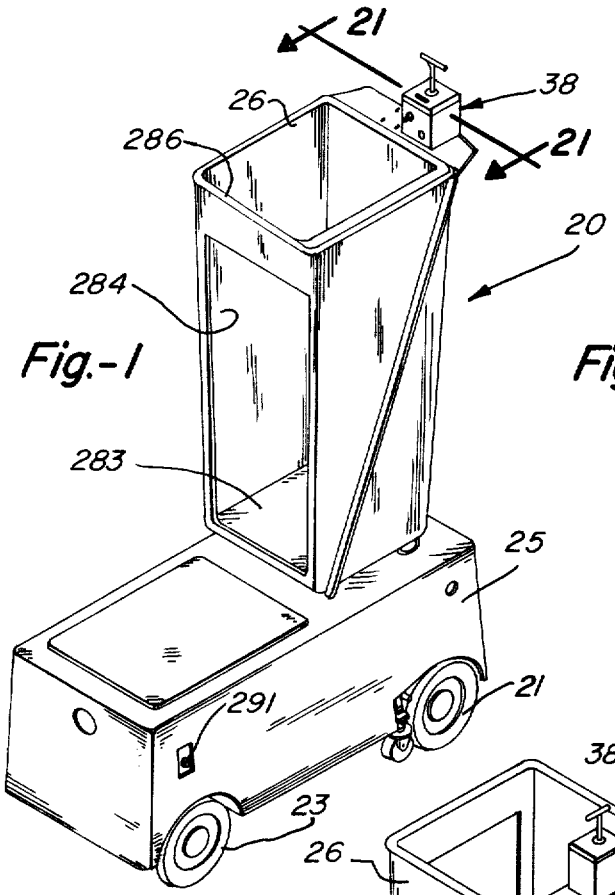
FIG. 1 is a perspective view of a powered manlift cart constructed in accordance with the invention.
Figure 2:
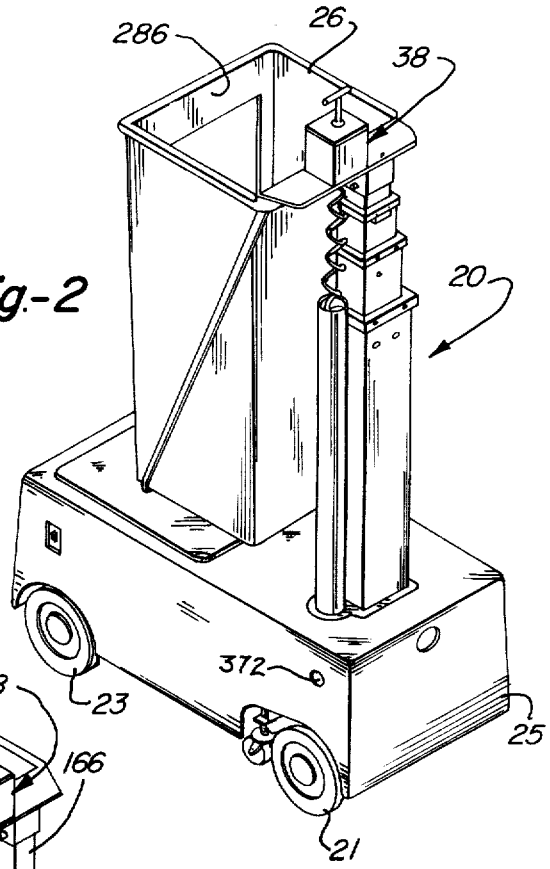
FIG. 2 is another perspective view of the manlift cart.
Figure 3:
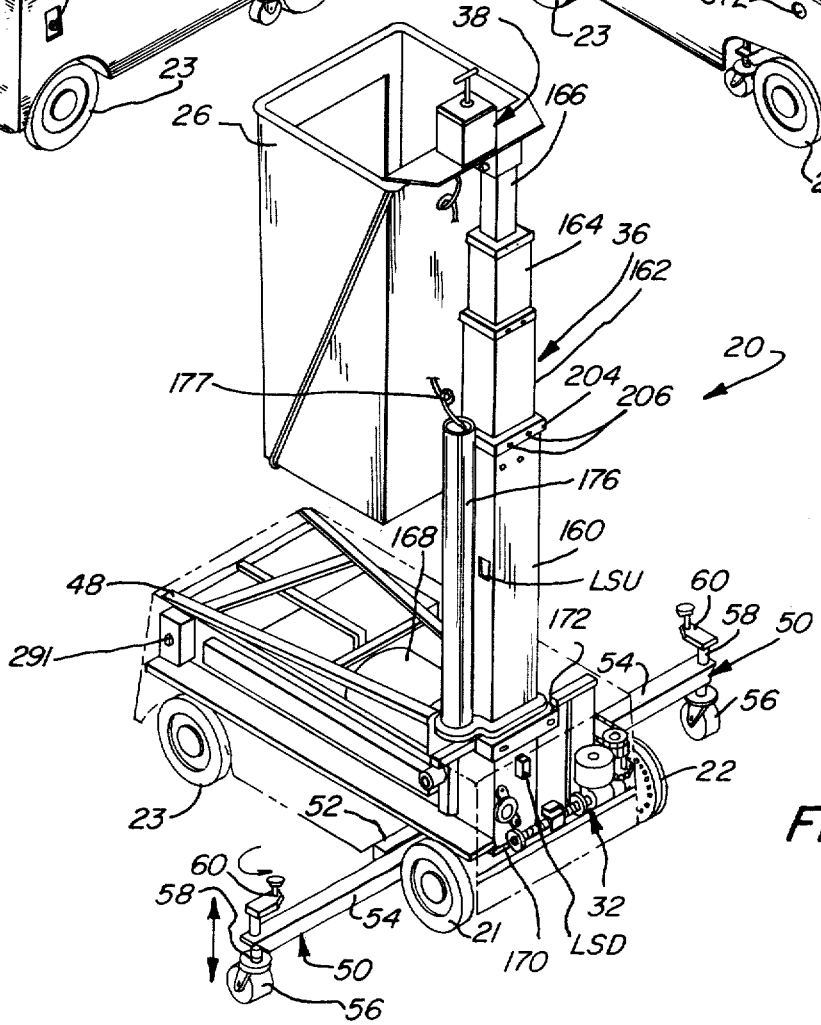
FIG. 3 is a perspective view of the manlift cart with the body removed.

Referring now to the drawings, a powered manlift cart constructed in accordance with the present invention is shown and generally designated by numeral 20. As shown in FIGS. 1, 2, and 3, the cart has a pair of front wheels 21 and 22 and a pair of rear wheels 23 and 24, a generally rectangular box-like body 25 and a support bucket 26 in which the machine operator stands during operation of the cart 20. In FIGS. 3 and 4 the cart 20 is shown with the body 25 removed showing various components of the cart which generally stated include a rigid support frame 28, a drive assembly 30 (FIG. 4) for driving the left front wheel 22 and the left rear wheel 24, power driven front steering assembly 32 and rear steering assembly **32*a* for independently steering the front wheels 21 and 22 and rear wheels 23 and 24, respectively, a power driven lift mast 36 for raising and lowering the support bucket 26, and a control box 38 operable by the machine operator for selectively controlling the speed and turning of the cart 20 and lift mast 36**.

SUPPORT FRAME

As shown in FIGS. 3 and 4 the support frame 28 is an all welded, unitary structure fabricated from structural steel members. Two parallel-spaced front and rear tubular steel wheel support members 40 and 42 (FIG. 4) are provided for attaching the front wheels 21 and 22 and rear wheels 23 and 24, respectively, and these members are joined and braced by two other parallel-spaced tubular longitudinal support members 44 and 46 that are positioned parallel to the longitudinal axis of the cart 20. In addition, an open framework 48 (FIG. 3) fabricated from angle members and bar stock is attached to the wheel support members 40 and 42 in a plane generally parallel to and above the wheel support members 40 and 42 for mounting the lift mast 36 to the body 25 and for mounting various other components of the cart 20.

As shown in FIG. 3 two outrigger assemblies 50 are mounted on either side of the support frame 28 and can be slid laterally out from the cart for providing a wider support base for the cart. Each outrigger assembly 50 comprises a stationary tubular slide support 52 attached to support members 44 and 46 of the support frame, a tubular slide member 54 slidably mounted to the slide support 52, and a caster 56 attached to a threaded shank 58 with a handle 60 mounted to a threaded hole on the end of the slide member 54. The handle 60 and threaded shank 58 may be rotated as indicated by an arrow for raising and lowering the caster 58. This arrangement permits the casters 58 on either side of the cart 20 to be slid laterally out from the cart 20 as shown in FIG. 3 and lowered to contact the ground for providing a wider support base for operation of the mast assembly 36, as for example on a sloped surface or the like. This arrangement, however, is a safety feature and is not required during normal operation of the cart as the wheels 21, 22, 23 and 24 of the cart will normally provide a sufficient support base for operating the cart 20 on most surfaces encountered.

WHEEL DRIVE ASSEMBLY

Figure 20:
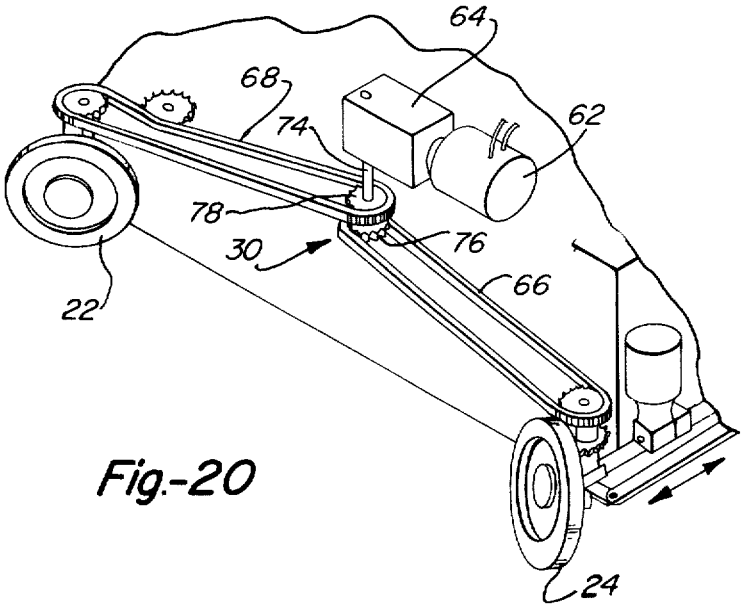
FIG. 20 is a rear perspective view of the cart showing the drive arrangement.

Referring now to FIGS. 4, 7 and 20, the wheel drive assembly 30 for rotatably driving the left front wheel 22 and left rear wheel 24 is shown. The left front wheel 22 and left rear wheel 24 are mounted for being driven by a drive motor 62 acting through a gear box 64 and drive chains 66 and 68, respectively.

The drive motor 62 is preferably a ¼ horsepower or more, direct current, 12 volt, 1725 rpm reversible electric motor. The drive gear box 64 is preferably a 90° reducing gear box and is coupled to the face of the drive motor reducing the output speed of the motor in the approximate ratio of 21 to 1. A mounting plate 70 (FIG. 4) is attached to the support frame 28 for mounting the gear box 64 and drive motor to the support frame 28 utilizing threaded fasteners with nuts 72. The gear box 64 is attached to the mounting plate 70 with its output shaft 74 (FIG. 7) generally vertically disposed at right angles to the longitudinal axis of the cart 20. A lower chain sprocket 76 and an upper chain sprocket 78 (FIGS. 7 and 20) are attached to the output shaft 74 of the gear box 64 utilizing keys or the like as drive sprockets for the drive chains 66 and 68 to the wheels. In addition a freely rotatable idler sprocket 80 (FIG. 4) is adjustably attached to a support bracket 84 attached to the support frame 28 for tensioning the drive chain 66. A similar idler sprocket may be provided for chain 68, but this is not shown.

Figure 8:
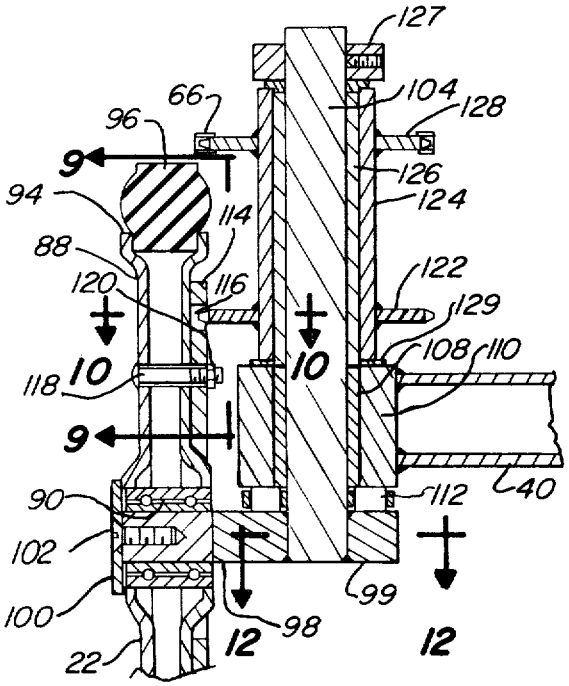
FIG. 8 is a cross-sectional view along section line 8—8 of FIG. 4 showing one of the driven wheels of the cart.

Referring now to FIG. 8, a mounting and drive arrangement for driving the left front wheel 22 of the cart is shown in more detail. The left front wheel 22 includes a metal hub 88 with a circular channel-like rim portion 94 wherein a rubber tire 96 or the like is mounted. A through bore extends through the hub and roller bearings 90 are press fitted to the bore. The roller bearings 90 are journaled to a first shaft 98 thus rotatably mounting the wheel 22 to the shaft 98. The bearings 90 abut a support block 99 on which the first shaft is mounted and the wheel is axially retained on the first shaft 98 abutting the support block 99 by a retaining plate 100 secured to the shaft 98 with a countersunk fastener 102 threaded to a tapped hole in the shaft. A second shaft 104 is also attached to the support block 99 preferably by welding at right angles to the first shaft 98. Second shaft 104 is journaled to a bronze bushing 108 mounted to a metal bearing block 110 welded to the front wheel support member 40 on the support frame. In addition a thrust needle bearing 112 is mounted to the second shaft 104 between the bearing block 110 and mounting block 99. Bushing 108 and needle bearing 112 support shaft 104 for pivoting by the steering mechanism for power steering the front wheel 22 as will hereinafter be explained.

Figure 9:
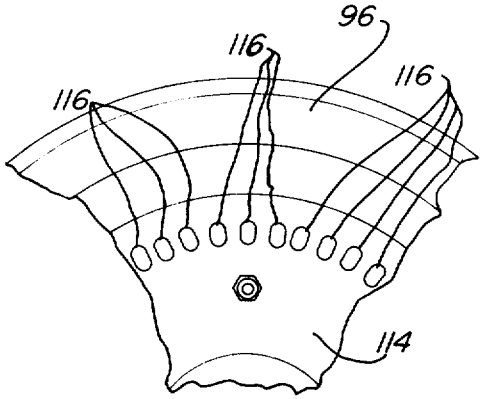
FIG. 9 is a sectional view taken along section line 9—9 of FIG. 8.
Figure 10:
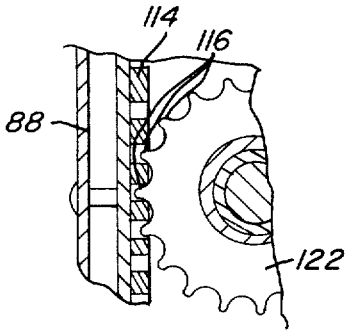
FIG. 10 is a cross-sectional view taken along section line 10—10 of FIG. 8.

For driving the front wheel 22 a gear plate 114 having a plurality of circumferentially spaced slots 116 (FIG. 9) is attached to the hub 88 utilizing threaded fasteners 118 and nuts 120. As shown in FIG. 10 the spaced slots 116 on the gear plate 114 mesh with the teeth of a drive sprocket 122 that turns the gear plate 114 and thus rotatably drives the wheel. Drive sprocket 122 is a conventional chain sprocket and is attached to a cylindrical sleeve 124 having a bronze bushing 126 press fitted to an interior concentric through bore. The sleeve 124 and bushing 126 are journaled to the second shaft 104 for rotation about the shaft and are retained on the shaft 126 by a shaft collar 127. A thrust washer 129 is journaled to the second shaft 104 between cylindrical sleeve 124 and support block 99. For rotating the sleeve 124 an upper chain sprocket 128 is attached to the sleeve above and parallel to lower sprocket 122 and is driven by drive chain 66 from the drive motor 62. With this arrangement rotation of drive sprocket 78 on the gear box 64 drives the chain 66 around sprocket 128 rotating sleeve 124 about shaft 104 and causing sprocket 122 to mesh with the radial slots 116 on the gear plate 114 and turn the wheel 22.

The left rear wheel 24 is also driven by the drive motor through sprocket 76 and chain drive 68 and is identical in construction and mounting to the left front wheel 22. The right front wheel 21 and rear wheel 23 are substantially identical in construction to the driven left wheels 22 and 24 and are mounted to the support frame in generally the same manner, but are freely rotable about a support shaft and therefore do not require a gear plate 114 and sprockets 122 and 128 for driving.

STEERING ASSEMBLIES

Figure 12:
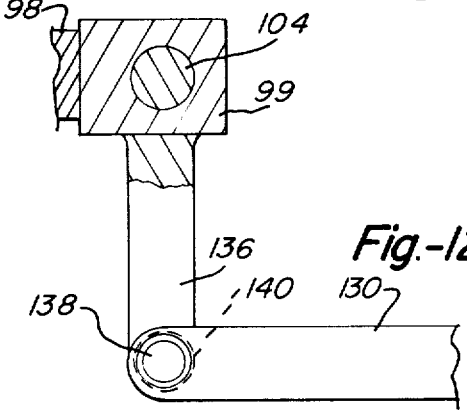
FIG. 12 is a detail cross-sectional view taken along line 12—12 of FIG. 8.

Referring now to FIGS. 5, 6 and 12, the front steering assembly and rear steering assembly (32 and 32*a*, respectively) are shown. The front and rear steering assemblies are identical in construction so that only an explanation of the elements of the front steering assembly will be given with the corresponding elements of the rear steering assembly designated by the suffix "a" after the reference numerals. As shown in FIG. 5 the front steering assembly 32 generally stated comprises a tie rod 130 pivotally attached to the front wheels 21 and 22 for turning the front wheels 21 and 22, two connecting members 136 at opposite ends of tie rod 130 connected to an associated shaft mounting block 99 for the right front wheel 21 and an associated shaft mounting block 99 for the left front wheel 22. One end of each connecting member 136 is preferably welded to the mounting block 99 at right angles to the shaft 98 and to the shaft 104. Each end of the tie rod 130 is then pivotally connected to the two connecting members 136 utilizing pivot pins 138 journaled to bronze bushings 140 press fitted through bores on each end of the tie rod 130. The arrangement is such that axial lateral movement of the tie rod 130 acting through the connecting members 136 turns both front wheels 21 and 22 an equal amount with the wheels pivoting about shafts 104 about generally vertical axes supported by thrust bearings 112 and bronze bushings 108.

The steering motor 131 for axially laterally moving the tie rod 130 is a direct drive, reversible electric motor coupled to a reducer 142 bolted to the face of the motor 131. The reducer 142 is pivotally mounted on the cart utilizing a support bracket welded to the support frame 28. The worm gear 132 is coupled to the output shaft of the reducer 142 supported for rotation about its longitudinal axis at one end by the reducer 142 and at the other end by the precision nut 132 which is pivotally attached to the tie rod 130. The precision nut 134 may be a conventional frictionless nut that utilizes an internal steel pin 149 which is driven by the teeth on the worm gear 132 or alternately may be a recirculating ball nut.

Figure 11:
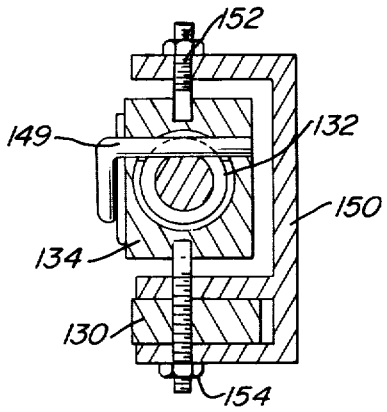
FIG. 11 is a cross-sectional view taken along line 11—11 of FIG. 5.

As shown in FIG. 11 a channel-like bracket 150 is attached to the tie bar preferably by welding. The precision nut 134 is pivotally attached to the bracket 150 utilizing two threaded fasteners 152 and 154 threaded to mounting holes on bracket 150 and secured to the bracket with nuts. Two stop collars 156 and 158 are attached to the worm gear 132 for limiting the axial movement of the precision nut 134 on the worm gear. This steering arrangement is such that rotation of the steering motor 131 in one direction rotates the worm gear 132 and drives the precision nut 134 in a first direction axially laterally moving the tie rod 130 and turning the front wheels 21 and 22. Rotation of the steering motor 131 in the opposite direction drives the precision nut in the opposite direction and turns the wheels the other way. The rotation of the steering motor may be stopped at any point so that the wheels may be oriented over a wide range of angles for steering the cart. In addition, operation of the front steering assembly 32 and rear steering assembly 32*a* is independent so that the front and rear wheels may be steered or turned independent of one another.

LIFT MAST

Referring again to FIG. 3 the lift mast 36 is shown. The lift mast 36 functions to raise and lower the support bucket 26 and includes a stationary mast section 160 mounted to the support frame 28 of the cart and first mast section 162, second mast section 164 and third mast section 166 slidably telescoped in one another and supported for telescoping axial movement relative to one another. A mast motor 168 connected through a cable and pulley arrangement to the mast sections functions to axially move telescoping mast sections in a generally vertical direction for extending and retracting the mast. The stationary mast section 160 is a length of rectangular tubing that is mounted to the support frame 28 generally perpendicular to the plane of the cart adjacent the front of the cart 20. The stationary mast section 160 is supported by a flat support plate 170 welded to the frame and is secured by a collar member 172 removably attached to framework 48 on the support frame 28. The stationary mast section is thus rigidly supported on the support frame 28 but easily detachable from the frame for shipping or transporting the cart 20. In addition to the stationary mast section 160, a stationary hollow tubular member 176 is mounted to the support frame 28 generally adjacent and parallel to the stationary mast section for housing a coiled wiring cable 177 to the control box 38 as will hereinafter be explained.

Figure 13:
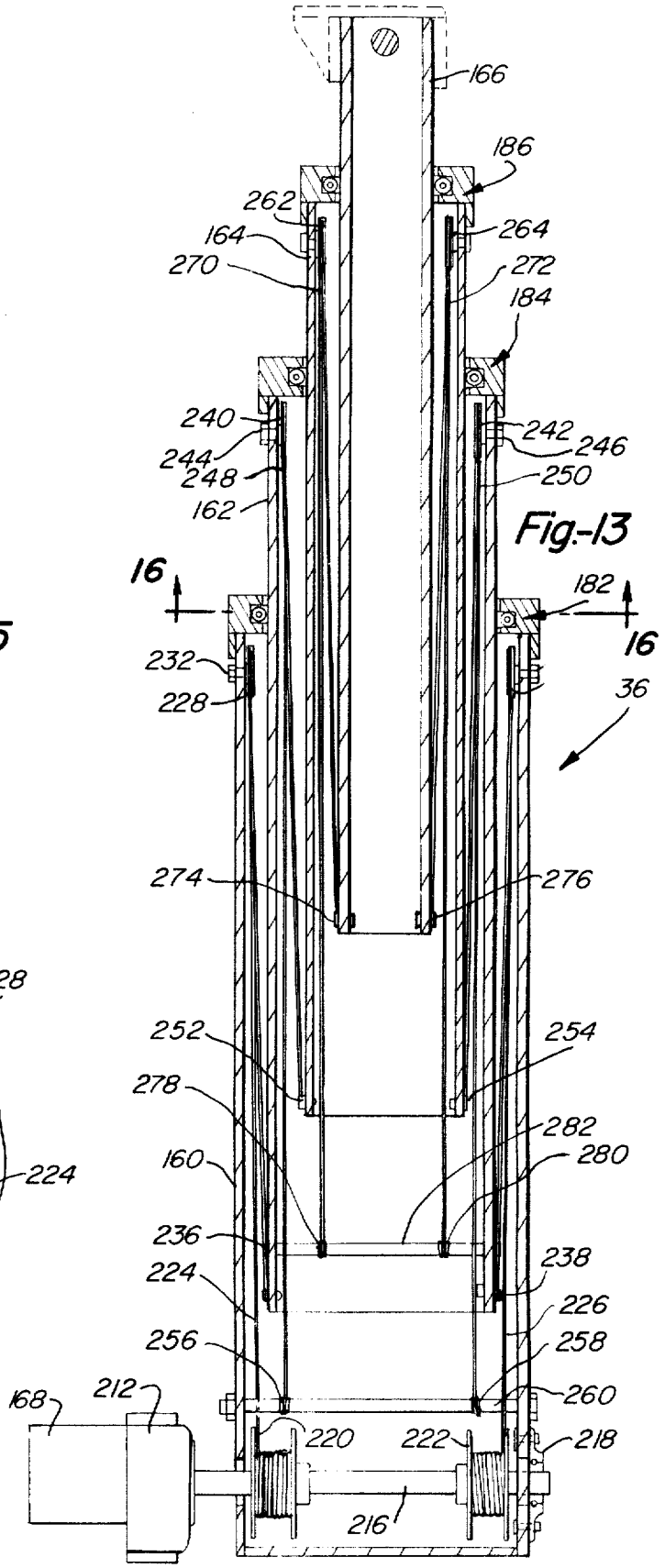
FIG. 13 is a cross-sectional elevation view of the mast assembly of the cart.

Referring now to FIG. 13 a cross sectional view of the lift mast is shown. The first movable mast section 162 is a length of square tubing telescoped within the stationary mast section 160 and is supported for axial movement relative to the stationary mast section by a bearing assembly 182 mounted to the upper end of the stationary mast section 160. Likewise, the second movable mast section 164 is a length of square tubing slidably telescoped within the first movable mast section supported for axial movement by a second bearing assembly 184 at the upper end of section 160. The third movable mast section 166 is a length of square tubing slidably telescoped within the second movable mast section 164 supported for axial movement by a third bearing assembly 186 at the upper end of section 164.

Figure 16:
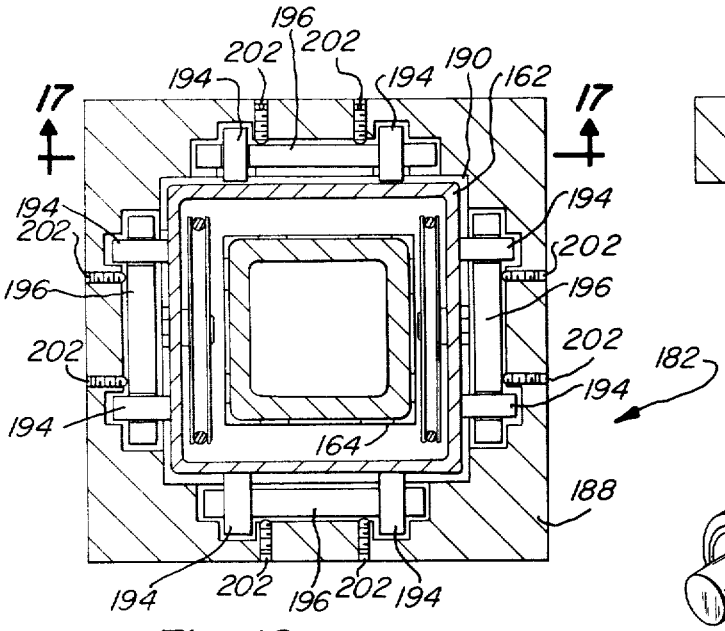
FIG. 16 is a cross-sectional view taken along section line 16—16 of FIG. 13 showing a bearing support assembly for a mast section.
Figure 17:
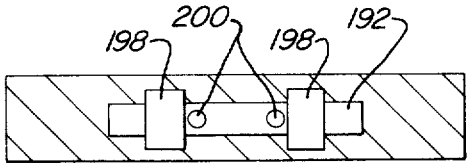
FIG. 17 is a cross-sectional view taken along section line 17—17 of FIG. 16.
Figure 18:
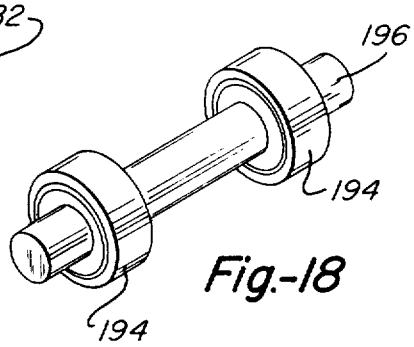
FIG. 18 is a detail perspective view of a bearing for the mast sections.

Referring now to FIG. 16 a cross section of a bearing assembly 182 for supporting the first movable mast section 162 within the stationary mast section 160 is shown. Bearing assemblies 184 and 186 are of a smaller size than bearing assembly 182, but are identical in construction so that a description of bearing assembly 184 will also apply to assemblies 184 and 186. Bearing assembly 182 comprises a flat generally square metal bearing mounting plate 188 having a generally square opening 190 for receiving the first movable mast section 162. In addition as shown in FIG. 17, four recessed slots 192 are machined in the plate 188 along the periphery of opening 190 wherein eight small roller bearings 194 are freely rotatably mounted for supporting mast section 160 for movement. The roller bearings 194 are freely rotatably mounted on four support shafts 196 which are inserted into the recessed slot 192 and supported by the walls of the slot 192. The recessed slot 192 in the bearing mounting plate 188 is provided with enlarged recesses 198 (FIG. 17) for housing the roller bearings 194 so that the roller bearings may rotate freely within the slot 192. The outer peripheral edge of each roller bearing 194 extends a short distance into rectangular opening 190 in plate 188 for engaging the outer surface of movable mast section 162. In addition bearing mounting plate 188 is provided with eight tapped holes 200 (FIG. 17). Two are on each of the four sides of the plate for receiving eight set screws 202 for adjusting the location of the shafts 196 and roller bearings 194 to engage mast section 162 with the roller bearings. The bearing mounting plate 188 is also provided with a mounting flange 204 (FIG. 3) around the outer periphery of the plate 188 that has eight mounting holes 206 for attaching the bearing assembly 182 to threaded holes on the mast section 160 utilizing threaded fasteners.

In a like manner movable mast section 164 is supported for axial movement within mast section 162 by bearing assembly 184 and movable mast section 166 is supported for axial movement within mast section 164 by bearing assembly 186.

Referring again to FIG. 13 the mast motor 168 and the cable and pulley arrangement for extending and retracting the movable mast sections is shown. The mast motor 168 is preferably a ¾ horsepower 1700 rpm electric motor and is mounted on the support frame 28 adjacent to the stationary mast section 160. The mast motor 168 is coupled to a two stage reducing gear box 212 which reduces the output speed of the electric motor 168 on the order of 100 to 1. The gear box 212 is attached to the face of the mast motor 168 and its output shaft 216 extends through a hole in the stationary mast section 160 and is supported for rotation by a pillow back bearing 218 attached to the outside of the stationary mast section 160. Two cable drums 220 and 222 are keyed or otherwise attached to output shaft 216 for rotation with the shaft. The cable drums 220 and 222 are located within the stationary mast section 160 spaced apart adjacent to opposite inner sidewalls of the mast section 160. Two steel cables 224 and 226 are attached to each drum for winding and unwinding around the drums 220 and 222, respectively, as the drums are turned. Two oppositely disposed idler pulleys 228 and 230 are freely rotatably mounted to the stationary mast section 160 near the top of the section on mounting studs 232 and 234, respectively, attached to the mast section 160. The steel cables 224 and 226 are placed around the pulleys 228 and 230, respectively, and are attached to the first movable mast section 162 at its lower end utilizing clamps 236 and 238, respectively, which are attached to the mast section 162. With this arrangement, winding of the cables 224 and 226 on the cabledrums 220 and 222, respectively, causes movable mast section 162 to move axially upward relative to stationary mast section 160 in a generally vertical direction supported by bearing assembly 182. Conversely, unwinding of the cables 224 and 226 causes the movable mast section to be axially lowered relative to the stationary mast section.

For moving the second movable mast section 164 another pair of oppositely disposed pulleys 240 and 242 are freely rotatably mounted on mounting studs 244 and 246, respectively, at the upper end of the first movable mast section 162, and another pair of steel cables 248 and 250 are wound around the pulleys 240 and 242, respectively, and attached at one end to the lower end portion of the second movable mast section 164 with clamps 252 and 254, respectively, and at the other end to a stationary stud 260 attached to the stationary mast section 160 with clamps 256 and 258, respectively. With this arrangement, upward movement of the first movable mast section 162 moves the attached pulleys 240 and 242 upward and causes the cables 248 and 250 to move the second movable mast section 164 in the same direction.

Figure 15:
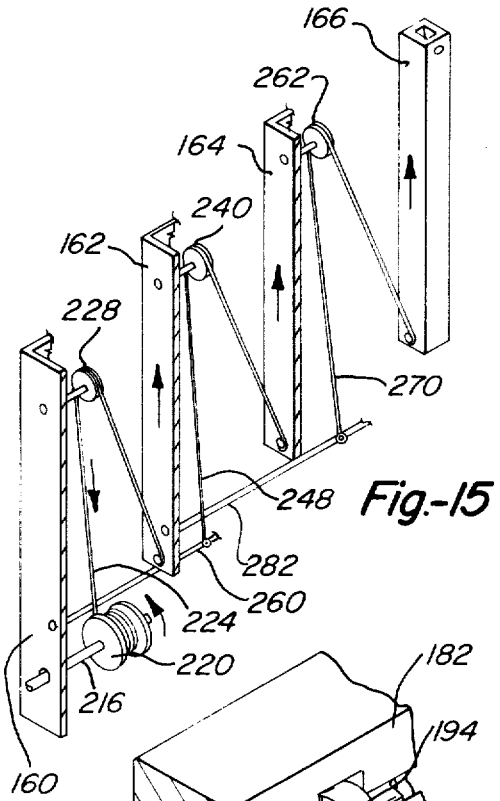
FIG. 15 is a schematic view showing the assembly of the mast.
Figure 14:
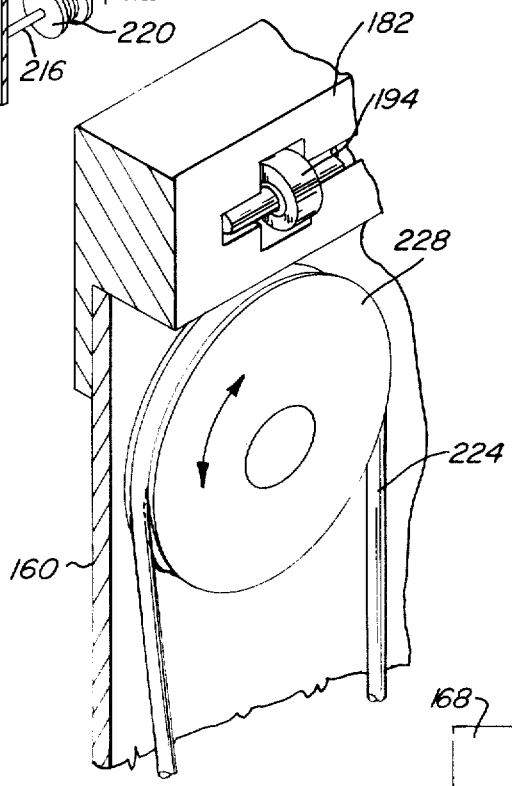
FIG. 14 is a detail view showing a pulley and cable arrangement on the mast.

For moving the third movable mast section 166, the same arrangement is utilized. Two oppositely disposed pulleys 262 and 264 are freely rotatably mounted on mounting studs at the upper end of the second movable mast section 164, and steel cables 270 and 272 are wound around the pulleys 244 and 246, respectively, and attached at one end to the lower end of the third movable mast section 166 with clamps 274 and 276, respectively, and at the other end with clamps 278 and 280, respectively, to a second stationary stud 282 attached to the lower end portion of the first movable mast section 162. With this arrangement movement of the second movable mast section 164 moves pulleys 262 and 264 and causes cables 270 and 272 to move the third movable mast section in the same direction. The pulley and cable arrangement for one side of the mast is shown in schematic form in FIG. 15.

Thus the mast motor 168 acting through cable drums 220 and 222 winding and unwinding cables 224 and 226 causes the movable mast sections 162, 164, and 166 to simultaneously move in the same direction for extending and retracting the mast. During operation of the mast the movable mast sections 162, 164, and 166 are supported by the bearing assemblies 182, 184 and 186, respectively.

The support bucket 26 is attached at its upper end to the third movable mast section 166 for movement with that section. As shown in FIGS. 1 and 2, the support bucket 26 is a generally rectangular box that may be fabricated from relatively light materials such as fiberglass or plastics. The bucket has a bottom platform 283 on which the operator stands which, as viewed from the top, has its center at approximately the center of the cart for balance. The top of the bucket 26 is open with a rectangular cut away portion 284 on one side providing an access opening. A safety rail 286 extends around the top opening.

POWER SOURCE

The power source for the cart and mast is two DC storage batteries 290 and 292. Preferably, they are heavy duty, high amperage batteries such as golf cart batteries. As shown in FIG. 4, they are mounted towards the rear of the cart on the cart support frame 28 in counterbalancing relation to the lift mast 36.

CONTROL BOX

Figure 22:
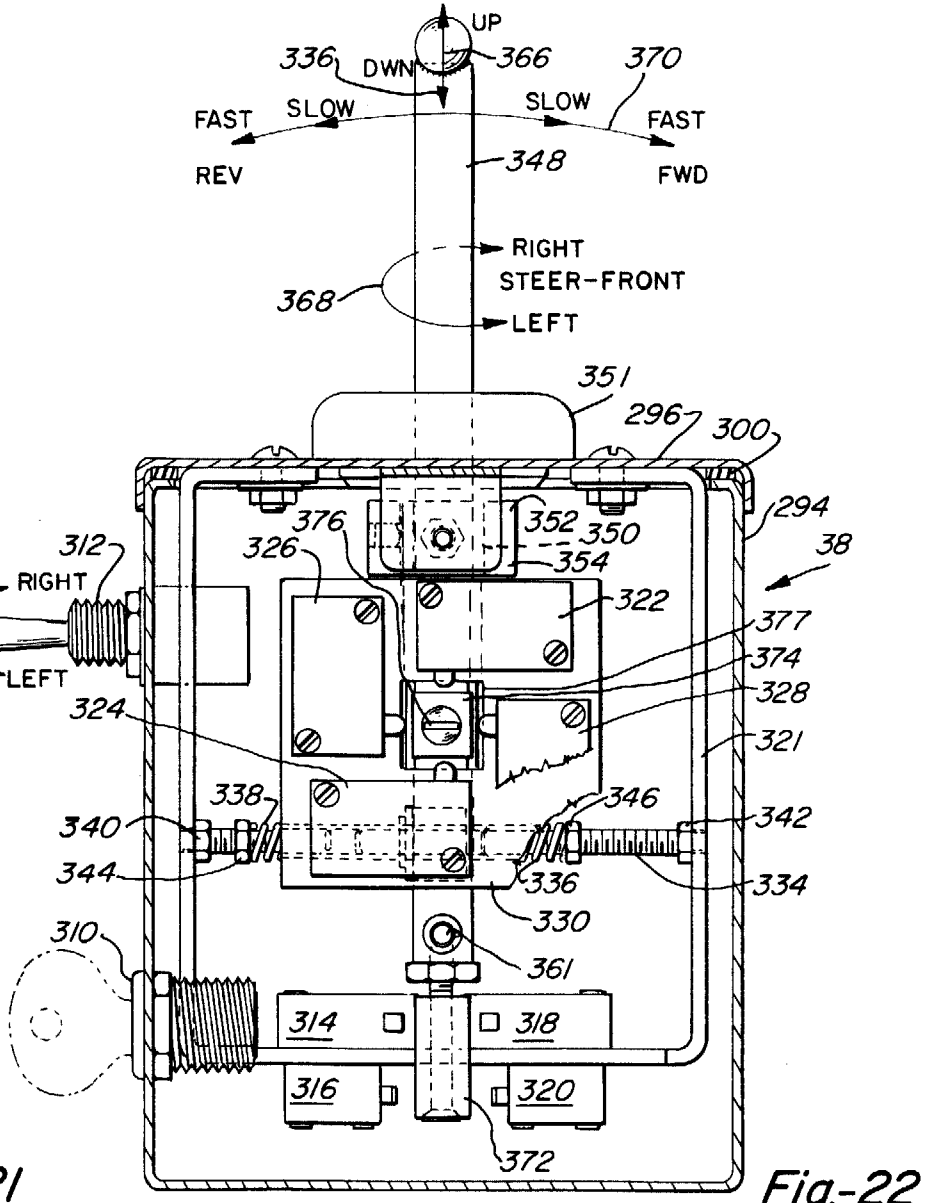
FIG. 22 is a cross-sectional elevation view of the control box taken along section line 22—22 of FIG. 21.
Figure 21:
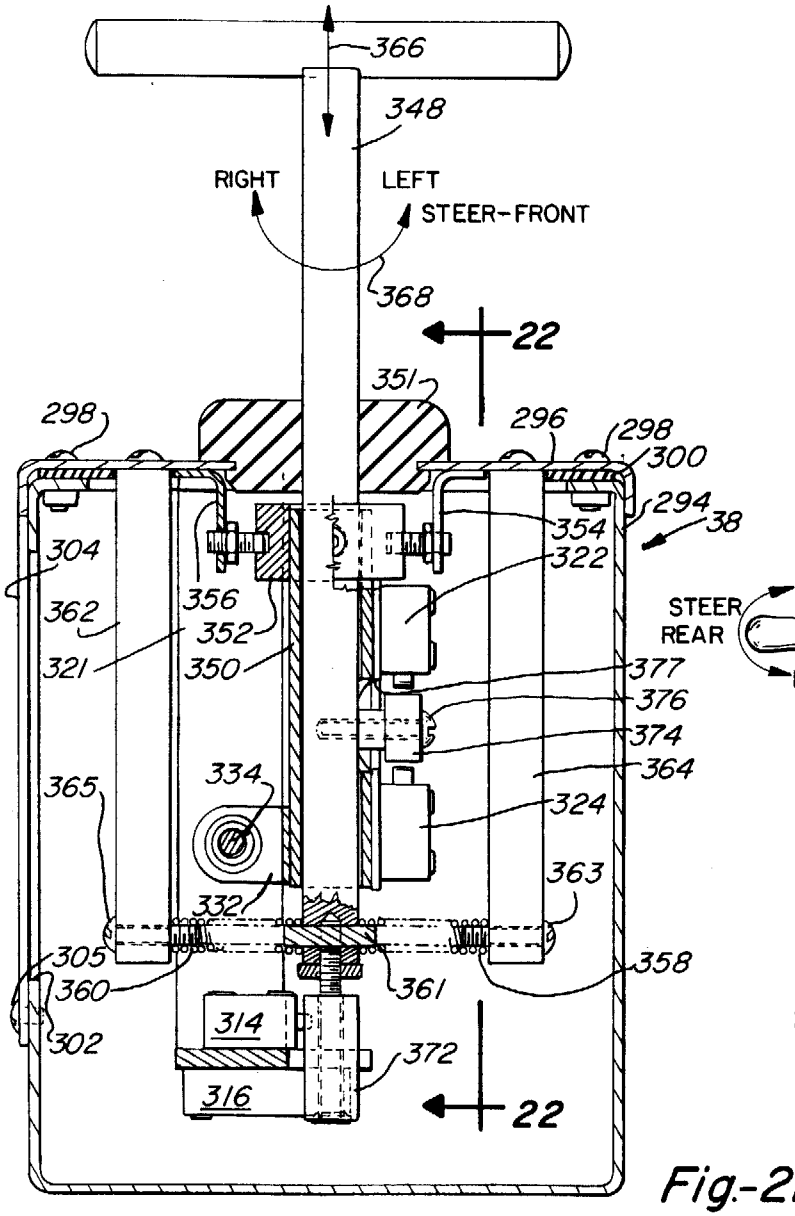
FIG. 21 is a cross-sectional view of a control box for the cart taken along section line 21—21 of FIG. 1.

Referring now to FIGS. 21 and 22 there is shown in more detail the control box 38 for selectively controlling the operation of the movement and steering of the cart and the mast. The control box 38, in general, contains a number of electric switches as is hereinafter described and is a small completely enclosed unit arranged for manual actuation by the machine operator. The control box 38 includes a box-shaped body 294 fabricated out of sheet metal and has a metal top cover piece 296 that is sealingly affixed to the body 294 with threaded fasteners 298 and nuts. A resilient gasket 300 is compressed between the body 294 and the top cover piece 296 for sealing the space therebetween. In addition, the body 294 of the control box has an access opening 302 which is normally covered by another metal cover piece 304 which is attached to the body with threaded fasteners 305.

A key switch 310 is mounted to the side of the control box 38 and as will hereinafter be explained may be used to lock or disable a number of the electric circuits of the cart. In addition, an electric toggle switch 312 is mounted to the side of the control box 38 and as will hereinafter be explained controls the operation of the rear steering assembly 32*a*. Four other electric switches 314, 316, 318 and 320 are mounted to a stationary C-shaped bracket 321 attached to the cover piece 296 of the control box and as will hereinafter be explained control the forward and reverse low and high speeds of the cart. Additionally, four more electric switches 322, 324, 326, and 328 are mounted on a switch mounting plate 330 in an intermediate area of the control box and as will hereinafter be explained control the upward and downward motion of the lift mast and the operation of the front steering assembly, respectively. The switch mounting plate 330 is movably attached to the C-shaped bracket 321 on a mounting ear 332 secured to a threaded shank 334 attached to the C-shaped bracket 321. The mounting ear 332 is sandwiched between two compression springs 336 and 338 on the threaded shank 334 so that the switch mounting plate 330 can move back and forth over the shank 334. It is normally biased by the compression springs 336 and 338 in the centered position shown in FIGS. 21 and 22. Two nuts 340 and 342 are threaded to the threaded shank 334 to secure the shank to the C-shaped bracket 321. Two other nuts 344 and 346 are attached to the threaded shank 334 and may be utilized to vary the compression on the compression springs 336 and 338.

For actuating the various control switches in the control box, a generally T-shaped control rod 348 is movably mounted to extend above and within the control box 38. The control rod extends through an opening in the center of the top cover piece 296 of the control box 38 into the interior of the control box and is journaled to a bushing 350 attached to movable switch mounting plate 330 in the control box. A resilient grommet 351 is attached to the control rod 348 for sealing around the control rod and the interface between the control rod 348 and the top cover 296 of the control box 38. The bushing 350 to which the control rod 348 is journaled is secured to a collar member 352 which is pivotally attached to two angle brackets 354 and 356 secured to the top cover 296 of the control box 38. In addition as shown in FIG. 22, the control rod 348 has a pin member 361 press fitted to the control rod generally perpendicular to the longitudinal axis of the rod attached to two compression springs 358 and 360 which are secured with cap screws 363 and 365 to two mounting studs 362 and 364 attached to the top cover piece 296 of the control box 38. The control rod may thus be moved up and down as indicated by double headed arrow 366, rotated clockwise or counterclockwise as indicated by double headed arrow 368, or pivot along an arc as indicated by double headed arrow 370 (FIG. 22). Compression springs 358 and 360 tend to resist the up and down and rotational motion of the control rod 348 and bias the rod to the centered position shown in FIGS. 21 and 22. Compression springs 336 and 338 tend to resist the pivotal motion of the control rod 348 and bias the rod to the vertical position shown.

For selectively actuating switches 314, 316, 318 and 320 within the control box a cylindrical roller member 372 is secured to the lower end to the control rod. By pivoting the control rod through a relatively small arc in either direction as indicated by arrow 370 the roller member 362 will contact either switch 314 or 318 according to the direction of movement. Pivoting the control rod through a larger arc causes the roller member 362 to contact either switch 316 or 320 according to the direction of movement. For actuating switches 322, 324, 326 and 328 in the control box, a small T-shaped actuating block 374 is attached at an intermediate position to the control rod 348 with a screw 376 threaded to a tapped hole in the rod. The switch mounting plate 330 and bushing 350 have rectangular openings 377, and the actuating block 374 extends through these openings. Upward motion of the control rod 348 as indicated by arrow 366 causes actuating block 374 to contact switch 322 and downward motion causes block 374 to contact switch 324. Rotational movement of the control rod 348 as indicated by arrow 368 causes the actuating block 374 to contact switch 326 when rotated in one direction and switch 328 when moved in the other direction. The up and down, rotational and pivotal motion of the control rod 348 are limited by the actuating block 374 contacting the edges of the rectangular opening 377 on the bushing 350 and on the switch mounting plate 330. This helps prevent damage to the switches by over-manipulation of the control rod 348.

CONTROL CIRCUIT

Figure 23:
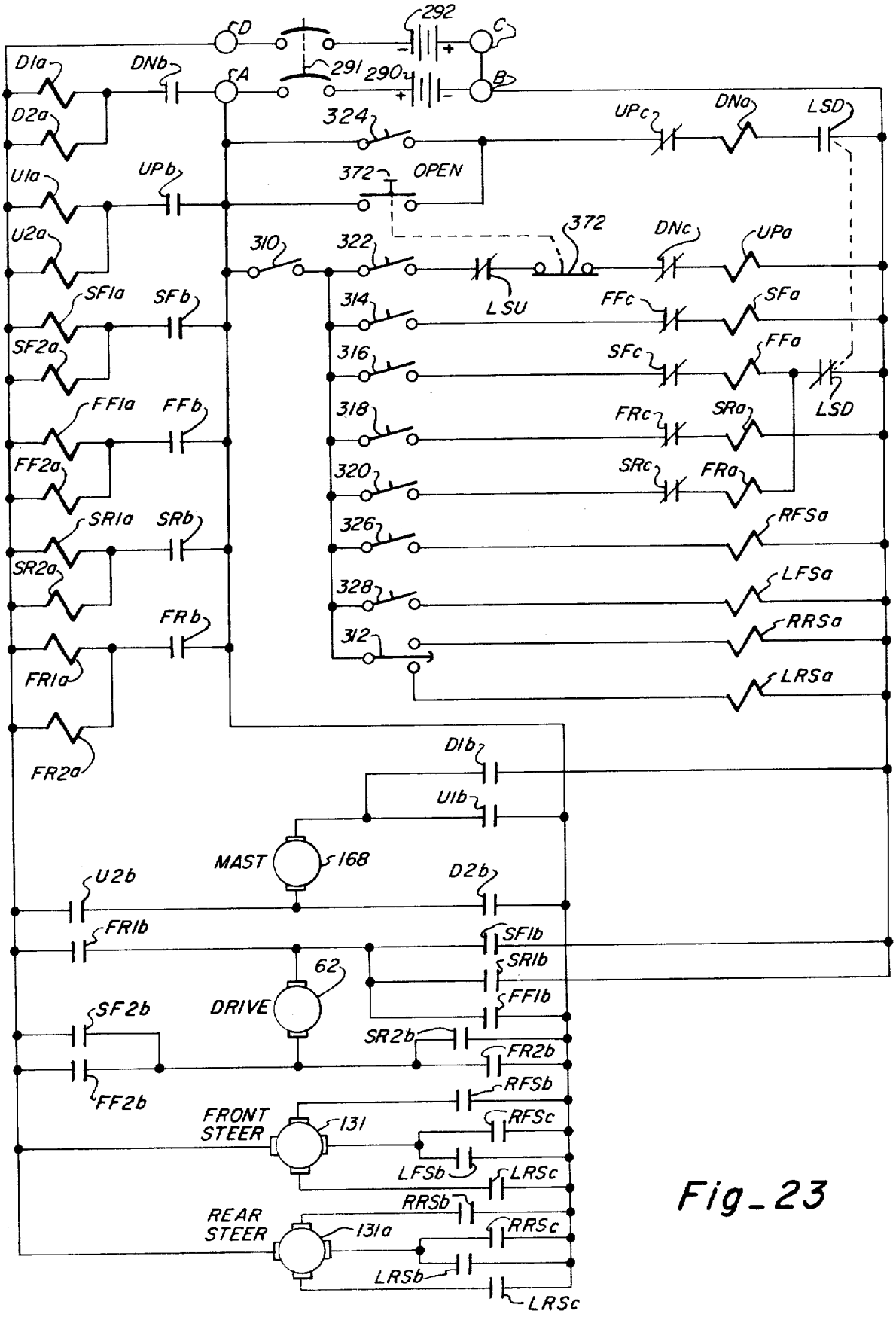
FIG. 23 is an electric circuit diagram showing the control for the cart.

Referring now to FIG. 23 the electric circuit for controlling the electric power for operating the cart and mast is shown. In the circuit the batteries 290 and 292 are arranged so that the negative electrode of battery 290 is connected to a terminal B, and the positive electrode of the battery 290 is connected via a set of contacts of a circuit breaker 291 to a terminal A. In turn, the positive electrode of battery 292 is connected to a terminal C and the negative electrode of battery 292 is connected via another set of contacts of circuit breaker 291 to a terminal D. With terminals B and C connected together, the electric potential across terminals A and D is 12 volts, across A and B is 6 volts, and across C and D is 6 volts.

In general, each electric switch is connected in series to an associated relay coil, each switch and associated relay coil being electrically connected between terminals A and B.

The mast-down electric switch 324 has a mast-down relay coil DNa, normally-closed relay contact UPc and a limit switch down LSD connected in series between terminals A and B. LSD is open when the mast is down and closes when the mast is raised. When switch 324 is closed, relay coil DNa is energized if the associated set of contacts of switch LSD is closed. One set of contacts of electric switch 372 is connected across switch 324 to bring the mast down even though the usual mast-down switch 324 in the control box is not closed.

The key electric switch 310 is connected in the circuit in series with all of the other electric control switches except switch 324 and the one set of normally-open contacts of switch 372 above described, so that switch 310 controls the current flow in all of the relay coil circuits except mast-down relay coil DNa for moving the mast down, as described more fully hereinafter.

A mast-up electric switch 322 is connected between terminals A and B in series with a limit switch up LSU, the other normally-closed set of contacts of switch 372, a normally-closed relay contact DNc, and the relay coil UPa for causing the mast motor to raise the mast. LSU is closed when the mast is down and opens when the mast is raised to its upper limit.

Each of the relays described hereinafter has a coil and one or more contacts that are actuated upon the energization of the associated coil. For reference purposes, the coil has the suffix "a" and the contacts the suffixes "b" and "c". For example, referring to the circuit for controlling the mast, the down relay coil DNa has a normally-open relay contact DNb and a normally-closed relay contact DNc. Relay contact DNb is connected in series with two parallel-connected contactor coils D1*a* and D2*a* that are across the 12-volt terminals A and D. Contactor coil D1*a* actuates normally-open contact D1*b* and contactor coil D2*a* actuates normally-open contact D2*b*. Contact D1*b* is connected to terminal B and to one side or to one input terminal of the mast motor 168, and contact D2*b* is connected to terminal A and to the other side or to the other input terminal of the mast motor 168 whereby when both contacts D1*b* and D2*b* are closed the voltage across terminals A and B is applied to the motor to cause the mast to be driven down.

In turn, the up relay coil UPa for the mast has a normally-closed relay contact UPc connected in series with the mast-down coil DNa, as above described, and a normally-open relay contact UPb. Contact UPb is connected in series with two parallel-connected contactor coils U1*a* and U2*a* between terminals A and D so that when contact UPb is closed, coils U1*a* and U1*b* are energized. Contactor coil U1*a* upon energization actuates normally-open contact U1*b* and contactor coil U2*a* upon energization actuates coil U2*b*. Contact U1*b* is connected to terminal A and to one side of mast motor 168, and contact U2*b* is connected to terminal D and to the other side of the mast motor whereby, when contacts U1*b* and U2*b* are closed, the mast motor is energized and the mast is raised.

In summary, for moving the mast assembly downward switch 324 is actuated by moving the control rod 348 downward as indicated by arrow 366. This causes relay coil DNa to be energized, closing contact DNb, energizing contactor coils D1*a* and D2*a*, and closing contacts D1*b* and D2*b*, which applies voltage of battery 290 to the mast motor 168 turning the motor in a direction for lowering the mast. In addition, the switch 372 which is physically mounted to the support frame 28 toward the front of the cart may be actuated for initiating the same sequence. For the up movement of the mast, switch 322 is closed by moving the control rod upward. This causes relay coil UPa to be energized, contact UPb closes, contactor coils U1*a* and U2*a* are energized, and contacts U1*b* and U2*b* close, applying the voltage of both batteries 290 and 292 to the mast motor 168 and turning the motor in a direction for raising the mast. Normally closed contacts UPc and DNc prevent simultaneous operation of the up and down circuits for the mast motor 168.

In general, the drive motor 62 and steering motors 131 and 132 are actuated by closure of switches and actuation of relay coils and contacts in the same manner as the mast motor above described with each switch causing the energization of a coil, closing a contact which in turn energizes two coils which in turn closes contacts to apply battery voltage to the loads.

Slow forward motion of the cart is regulated by switch 314. For moving the cart at slow forward speed, switch 314 is closed by pivoting the control rod 348 to the slow forward position indicated by arrow 370. This energizes relay coil SFa, closes relay contact SFb, energizes contactor coils SF1*a* and SF2*a*, closes contacts SF1*b* and SF2*b*, and applies voltage across A and B to the drive motor 62, causing the drive motor 62 to turn at a slow forward speed.

Fast forward motion is regulated by switch 316. For moving the cart at fast forward speed, switch 316 is closed by pivoting the control rod 348 to the fast position indicated by arrow 370. The movement of the control rod 348 past slow forward switch 314 causes this switch to reopen. Closing switch 316 energizes relay coil FFa, closes relay contact FFb, energizes contactor coils FF1*a* and FF2*a*, closes contacts FF1*b* and FF2*b*, and applies voltage across terminals A and D of twelve volts to the drive motor 62 causing the drive motor to turn at a fast forward speed.

Normally-closed relay contacts FFc and SFc prevent simultaneous operation of the fast forward and slow forward circuits. Limit switch LSD on the mast assembly opens one set and closes another set of contacts connected in the fast forward and fast reverse circuits to prevent operation of the cart at fast speeds while the mast is in its extended position.

For moving the cart at a slow reverse speed, switch 318 is closed by pivoting the control rod 348 to the slow reverse position indicated by arrow 370. The closure of switch 318 energizes relay coil SRa, closes relay contact SRb, energizes contactor coils SR1*a* and SR2*a*, closes contacts SR1*b* and SR2*b*, and applies voltage across A and B causing the drive motor 62 to turn at a slow reverse speed. Fast reverse motion is initiated by closing switch 320 by pivoting the control rod to the fast reverse position indicated by arrow 370. This energizes relay FRa, closes contact FRb, energizes relays FR1*a* and FR2*a*, closes contacts FR1*b* and FR2*b*, and applies voltage across A and D to the drive motor 62 turning the motor at the fast reverse speed. Normally-closed contacts FRc and SRc prevent simultaneous operation of the slow and fast reverse circuits.

Motion of the steering assemblies 32, 32*a* on the cart is controlled by switches 326, 328 and 312. For turning the front wheels toward the right, switch 326 is closed by rotating the control rod clockwise as indicated by arrow 368. This energizes relay coil RFSa, closes relay contacts RFSb and RFSc, and applies voltage across A and D to the front steering motor 131, causing the motor to rotate for turning the wheels toward the right. Likewise, the front wheels may be turned to the left by rotating the control rod 348 counterclockwise, which closes switch 328. This energizes relay coil LFSa, closes relay contacts LFSb and LRSc, and applies voltage across A and D to the front steering motor 131, causing the motor to rotate for turning the wheels toward the left.

Switch 312 controls the turning of the rear wheels. For turning the rear wheels to the right, switch 312 is thrown to the right, which energizes relay coil RRSa, closes relay contacts RRSb and RRSc, and applies voltage across A and D to the rear steering motor 131*a*, turning the rear wheels toward the right. Likewise, for turning the rear wheels toward the left, switch 312 is thrown toward the left, which energizes relay coil LRSa, closes relay contacts LRSb and LRSc, and applies voltage across A and D to the rear steering motor 131*a*, turning the rear wheels toward the left.

OPERATION

Figure 19:
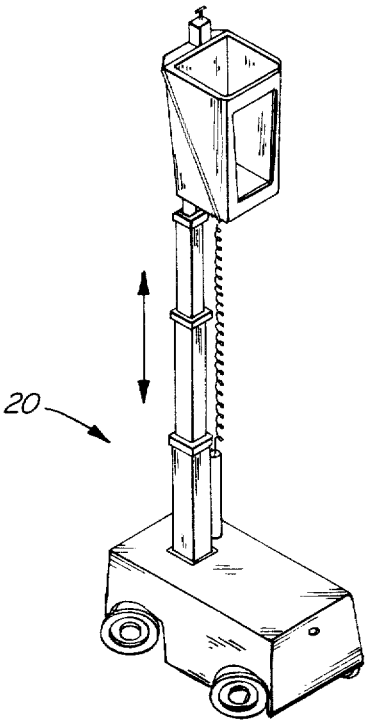
FIG. 19 is a perspective view of the cart showing the mast in its elevated position.

In the operation of the above described powered manlift cart, the control rod 348 may be actuated while the operator is standing on the platform of the lift bucket, or the control box 38 is demountable from the bucket and with the long cord 177 may be operated particularly for vehicular movement while the operator is standing beside the cart. By the selective operation of the control switches above described, the front and rear wheels may be turned in opposite directions as shown in FIG. 20 to turn a tight radius or as shown in FIG. 19 to direct the cart in oblique directions. In addition, the cart may be moved in a forward direction or reverse direction at high or low speeds. Finally, the mast and thereby the platform is raised to a desired height by the up or down movement (momentarily or continuously) of the control rod.

By way of example and not by way of limitation, a manlift cart suitable for being operated indoors in most commercial and residential applications has the following dimensions:

height of cart body: 20.25 inches
width of cart body: 2 feet
length of cart body: 4 feet
wheelbase: 23 in. × 33½ in.
turning radius: 3.5 feet
height of mast retracted: 6.25 feet
working height of operator when mast is extended: 16 feet
total weight: approx. 425 pounds Because of the small size and maneuverability of the cart of the present invention, the unit can be operated satisfactorily indoors in most commercial and residential applications. A cart of the above specifications has been operated on carpeted surfaces without harming the carpeting.

While the present invention has been described with a certain degree of particularity, it is understood that the present disclosure has been made by way of example and that changes in details of structure may be made without departing from the spirit thereof.

What is claimed is:

1. A powered manlift cart comprising:

a frame with steerable wheels rotatably mounted thereto for supporting said frame for movement, there being a first pair of steerable wheels at one end of said frame and a second pair of steerable wheels at the opposite end of said frame, said first and second pairs being turnable independently of one another;

powered wheel drive means for rotating at least a pair of said wheels for moving said frame;

powered steering drive means for turning said first pair of steerable wheels in either direction and said second pair of steerable wheels in either direction independently of the turning of said first pair of wheels for steering said cart;

a mast including a generally vertically disposed stationary mast section carried by said frame and a first movable mast section slidable within said stationary mast section and supported for vertical movement relative to said stationary mast section, said movable mast section having a support for raising and supporting an operator at selected elevated heights;

powered mast drive means for extending and retracting said movable mast section; and control means operable by the operator for selectively controlling said wheel drive means, said steering drive means and said mast drive means.

2. A powered manlift cart as defined in claim 1 wherein one of said first pair and one of said second pair of wheels are on the same side of said cart being driven by said wheel drive means.

3. A powered manlift cart as defined in claim 2 wherein said wheel drive means includes:

a reversible drive motor;

a driven one of said first pair and a driven one of said second pair of said wheels each having a plate with a plurality of circumferentially spaced apertures;

a sprocket rotatably mounted to said frame on each driven wheel for meshing engagement with said apertures on each driven wheel for driving the associated wheel; and means for rotating the sprockets on each driven wheel with said wheel drive motor.

4. A powered manlift cart as defined in claim 1 wherein said steering drive means includes:

a reversible steering motor for each of said pairs of wheels;

a tie rod pivotally coupled at opposite ends to each of said pairs of wheels, said tie rods being axially laterally movable for turning said pairs of wheels; and means powered by said steering motor for selectively axially, laterally moving said tie rods for turning said pairs of wheels.

5. A powered manlift cart as defined in claim 1 wherein said mast drive means includes:

a reversible mast motor;

a cable drum driven by said mast motor;

a first cable pulley rotatably mounted to said stationary mast section above said cable drum; and a first cable attached at one end to said cable drum for winding and unwinding by said cable drum and supported by said first cable pulley and attached at the other end to said first movable mast section whereby unwinding and winding the cable around said cable drum raises and lowers said first movable mast section.

6. A powered manlift cart as defined in claim 5 further including:

second and third movable mast sections slidable in said stationary mast section and supported for vertical movement relative to one another, each inwardly succeeding movable mast section having a smaller cross section;

a second cable pulley rotatably mounted to said first movable mast section;

a second cable attached at one end to said stationary mast section below said second cable pulley and supported by said second cable pulley and attached at the other end to said second movable mast section whereby movement of said first movable mast section moves said second movable mast section;

a third cable pulley rotatably mounted to said second movable mast section; and a third cable attached at one end to said first movable mast section below said third cable pulley and supported by said third cable pulley and attached at the other end to said third movable mast section whereby movement of said first and second movable mast sections moves said third movable mast section.

7. A powered manlift cart as defined in claim 1 wherein said control means includes a single control rod operable by the machine operator for controlling said wheel drive means, said steering drive means and said mast drive means according to the position of said control rod.

8. A powered manlift cart as defined in claim 1 wherein said control rod is carried by a control box fastened to said cart by an extensible line whereby said control rod is operable by an operator on said support and alternatively by an operator standing beside said cart.

9. A powered manlift cart as defined in claim 7 wherein said control means includes a single control box having a housing with said control rod supported by said housing extending into and projecting beyond said housing, said control rod being mounted for vertical movement along its longitudinal axis, for pivoting motion about an axis generally perpendicular to its longitudinal axis, and rotational movement about its longitudinal axis;

bias means for biasing the control rod in a centered position with respect to said housing with its longitudinal axis generally vertically disposed and for opposing rotational, vertical, and pivotal motion;

first electric switch means in said housing arranged for actuation by said control rod during pivoting of the rod for controlling the rotational movement of the wheels of said cart;

second electric switch means in said housing arranged for actuation by vertical movement of said control rod for controlling the movement of said mast; and third electric switch means in said housing arranged for actuation by the rotational movement of said control rod for controlling the turning of said cart.

10. A powered manlift cart as defined in claim 1 wherein said wheel drive means, steering drive means and mast drive means are powered by an electric storage battery carried by said frame.

11. A powered manlift cart as defined in claim 1 wherein said operator support is in the form of a bucket with a platform portion on which the operator stands and an annular grip rail above said platform portion for encircling the operator and for gripping by said operator.

12. A powered manlift cart as defined in claim 1 wherein the steering drive means includes:

means for mounting said pairs of said wheels for pivotal movement of each of said pairs of wheels about an associated generally vertical axis;

a tie rod attached to each of the pairs of pivotally mounted wheels axially movable for turning each of said pairs of wheels;

a steering motor; and means for transmitting power from said steering motor to said tie rods for axially moving said tie rods for turning the wheels, said means for transmitting power including:

a worm gear coupled to said steering motor for rotation by said steering motor; and a nut pivotally mounted to said tie rod and coupled to said worm gear for movement by said worm gear for axially moving said tie rod.

13. A powered manlift cart as defined in claim 12 wherein said nut is of the recirculating ball type and said worm gear has stop means at each end to limit the extent of said nut.

14. A powered manlift cart as defined in claim 1 wherein there are three movable mast sections.

15. A powered manlift cart as defined in claim 14 wherein said mast drive means includes:

a mast motor;

a cable drum coupled to said mast motor for rotation by said mast motor;

a first cable pulley rotatably mounted to said stationary mast section;

a first cable attached at one end to said cable drum for winding and unwinding by said cable drum and supported by said first cable pulley and attached at the other end to said first movable mast section;

a second cable pulley rotatably mounted to said first movable mast section;

a second cable attached at one end to said stationary mast section and supported by said second cable pulley and attached at the other end to said second movable mast section;

a third cable pulley rotatably mounted to said second movable mast section; and a third cable attached at one end to said first movable mast section and supported by said third cable pulley and attached at the other end to said third movable mast section whereby rotation of said first cable around said cable drum simultaneously moves said first, second, and third movable mast sections.

16. A powered manlift cart as set forth in claim 14 wherein said stationary mast section and the outermost two of said three movable mast sections carry bearing assemblies at their upper ends for slidably supporting the associated movable mast section slidable therein.

17. A powered manlift cart comprising:

a frame with steerable wheels rotatably mounted thereto for supporting said frame for movement;

powered wheel drive means for rotating at least a pair of said wheels for moving said frame;

powered steering drive means for turning at least a pair of said wheels for steering said cart;

a mast including a generally vertically disposed stationary mast section carried by said frame and a first movable mast section slidable within said stationary mast section and supported for vertical movement relative to said stationary mast section, said movable mast section having a support for raising and supporting an operator at selected elevated heights;

powered mast drive means for extending and retracting said movable mast section; and control means operable by the operator for selectively controlling said wheel drive means, said steering drive means and said mast drive means, said drive means including a reversible electric motor and said control means including relays each including coils and contacts selectively actuated by electric switches to regulate the electric power from an electric power source carried by said cart to said electric motors.

18. A powered manlift cart as defined in claim 17 including an electric switch to remove power from all of said drive means except the power to drive said mast drive motor in a direction to drive the mast down.

19. A powered manlift cart as defined in claim 17 wherein said relay coils and contacts are interlocked electrically so that reverse functions cannot energize contacts to send conflicting signals to the drive motors.

20. A powered manlift cart as set forth in claim 17 wherein said electric motors are powered by an electric storage battery means providing more than one DC voltage whereby a combination of voltages is applied to said motors and relays to selectively drive said electric motors, said electric motor for rotating said wheels moving at two different speeds in response to the application of two different voltages.

21. A powered manlift cart comprising:

a frame with steerable wheels rotatably mounted thereto for supporting said frame for movement;

powered wheel drive means for rotating at least a pair of said wheels for moving said frame, said wheel drive means including:

a reversible wheel drive motor, a reducing gear box coupled to said drive motor, a first drive sprocket coupled to an output shaft of said gear box, a second drive sprocket mounted for rotation about an axis by a drive chain from said first drive sprocket, a gear plate attached to each of said wheels having a plurality of circumferentially spaced slots, and a third drive sprocket attached to said second drive sprocket for rotation about said axis and mounted such that its teeth engage the circumferential slots on the gear plate to turn said wheels;

powered steering drive means for turning at least a pair of said wheels for steering said cart;

a mast including a generally vertically disposed stationary mast section carried by said frame and a first movable mast section slidable within said stationary mast section and supported for vertical movement relative to said stationary mast section, said movable mast section having a support for raising and supporting an operator at selected elevated heights;

powered mast drive means for extending and retracting said movable mast section; and control means operable by the operator for selectively controlling said wheel drive means, said steering drive means and said mast drive means.

22. An electrically powered manlift cart comprising:

a frame;

an electric storage battery power source carried by said frame;

a pair of front wheels and a pair of rear wheels rotatably mounted to said frame for vehicular movement thereof;

wheel drive means powered by said power source for driving at least one wheel;

steering drive means powered by said power source for steering a set of said wheels;

a telescoping mast including a stationary, generally vertically disposed section of tubing attached to the support frame and a plurality of movable sections of tubing with each inwardly succeeding section of tubing decreasing in cross section, said movable sections being slidably telescoped within said stationary section and supported for vertical movement relative to one another and to said stationary section;

a support attached to the telescoping mast for movement with the mast for raising and supporting an operator at different elevated heights;

mast drive means powered by said power source for moving said mast section; and control means including a single control rod operable by an operator for selectively controlling said wheel drive means, said steering drive means, and said mast drive means according to the position of said control rod.

23. An electrically powered manlift cart comprising:

a support frame;

a pair of rear wheels and a pair of front wheels rotatably mounted to said support frame, each of said pairs of wheels being pivotally mounted for steering;

an electric storage battery power source providing two different DC voltages carried by said frame;

an electric, reversible, wheel-drive motor carried by said frame powered by said power source having two different speeds according to the selected voltage applied thereto;

a gear plate with a plurality of circumferentially spaced slots mounted to each of a front driven wheel and a rear driven wheel, with the spaced slots in meshing engagement with the teeth of a drive sprocket rotatably mounted to said frame;

a drive train from said wheel-drive motor to said drive sprockets for turning said drive sprockets and driving each driven wheel;

a tie rod pivotally mounted to each pair of wheels and axially laterally movable for turning the associated wheels for steering the cart;

an electric, reversible, steering motor powered by said power source coupled to each tie rod for axially laterally moving each tie rod;

a telescoping mast having a support for an operator and including a stationary, generally vertically disposed section of tubing mounted to said support frame and at least two movable sections of tubing of inwardly succeeding decreasing cross-sectional configuration slidably telescoping within said stationary section and supported for vertical movement relative to one another for raising and lowering said operator support;

an electric, reversible, mast motor carried by said support frame powered by said power source coupled to a first cable supported by a rotatable cable pulley mounted to said stationary mast section and attached at one end to a first movable mast section whereby rotation of said mast motor may be used to wind or unwind the first cable and raise or lower said first movable mast section with respect to the stationary mast section;

a second cable pulley rotatably mounted to said first movable mast section;

a second cable attached at one end to said stationary mast section and supported by said second cable pulley and attached at the other end to a third movable mast section whereby vertical movement of the second movable mast section moves said third movable mast section; and control means including a control box having a single control rod arranged for selectively actuating a plurality of electric switches for selectively operating said wheeldrive motor, mast motor and steering motor.

24. Steering apparatus for turning two pairs of pivotally mounted wheels for a vehicle comprising:

a steering motor for each of said pairs of wheels;

a tie rod pivotally attached to each of said pairs of wheels such that axial lateral movement of the tie rod turns the associated pair of wheels;

a worm gear coupled to each steering motor for rotation by the motor; and a nut pivotally attached to each tie rod having internal threads rotating with threads on the worm gear for axial displacement along said worm gear by rotation of the worm gear for laterally moving said tie rod for turning said wheels.

25. Drive apparatus for vehicular movement of a vehicle comprising:

a cart having a first and a second pair of rotatably mounted wheels, one each of said pairs of wheels being a drive wheel, said drive wheel being mounted on a common side of said cart;

a gear plate attached to each drive wheel having a plurality of circumferentially spaced slots;

a drive motor mounted to said cart;

a drive sprocket for each drive wheel rotatably mounted to the cart having teeth in meshing engagement with the slots on said gear plates; and means for transmitting power from said drive motor to said drive sprockets for simultaneously rotating said drive sprockets for driving said drive wheels.

26. Drive apparatus as defined in claim 25 wherein said means for transmitting power includes:

a reducing gear box coupled to said drive motor;

a first chain sprocket attached to an output shaft of said gear box for rotation therewith;

a second chain sprocket for each of said drive wheels attached to the drive sprocket; and a chain for each of said drive wheels attached to the associated first chain sprocket and the associated second chain sprocket for transmitting motion of the associated first chain sprocket to the associated second chain sprocket and to the associated drive sprocket for driving said drive wheels.

27. Control apparatus for regulating the operation of a vehicle having a first pair of steerable wheels at one end and a second pair of wheels at the opposite end comprising:

a housing;

a control rod supported by said housing extending into and projecting beyond said housing, said control rod being mounted for rotational movement about its longitudinal axis and for pivoting motion about an axis generally perpendicular to its longitudinal axis;

bias means for biasing the control rod in a centered position with respect to said housing with its longitudinal axis generally vertically disposed and for opposing rotational and pivotal motion of the control rod;

first electric switch means arranged for actuation by the control rod during pivoting of the rod and coupled to said wheels for controlling the rpm of said wheels to control the speed of said vehicle; and second electric switch means in said housing for actuation by rotational movement of said control rod and coupled to said wheels for controlling the turning of said wheels for controlling the steering of said vehicle.

28. A telescoping mast assembly adapted for mounting on a vehicle comprising:

a stationary mast section;

at least first and second movable mast sections of inwardly succeeding decreasing cross-sectional configuration slidably telescoping within said stationary mast section between extended and retracted positions, each of said mast sections having a pair of opposed sidewalls arranged parallel to one another, said stationary and outermost movable mast sections carrying bearing assemblies at their upper ends in each of associated of said pairs of sidewalls for slidably supporting an associated movable mast section therein; and mast drive means connected with said mast sections for simultaneously raising and lowering said movable mast section, said mast drive means including:

a reversible mast motor, a pair of cable drums at axially spaced positions on a common shaft arranged for simultaneous rotation by said mast motor, a first cable pulley rotatably mounted to said stationary mast section on each of two of said opposed sidewalls thereof, a first cable attached at one end to each of said cable drums for winding and unwinding by said cable drums and supported by an associated first cable pulley and attached at the other end to said first movable mast section, a second cable pulley rotatably mounted to said first movable mast section on each of two of said opposed sidewalls thereof, and a second cable attached at one end to said stationary mast section on each of two of said opposed sidewalls thereof and supported by an associated second cable pulley and attached at the other end to said second movable mast section, whereby rotation of said frist cables around said cable drums simultaneously moves said movable mast sections.

* * * * *